United States Patent [19]

Stolarz

[11] 4,276,676

[45] Jul. 7, 1981

[54] HANDLE MOUNTING DEVICE

[75] Inventor: Edward M. Stolarz, Yorktown Heights, N.Y.

[73] Assignee: Presto Lock Company, Division of Walter Kidde & Company, Inc., Garfield, N.J.

[21] Appl. No.: 62,033

[22] Filed: Jul. 30, 1979

[51] Int. Cl.[3] ..... A47B 95/02

[52] U.S. Cl. ..... 16/126; 190/58 R

[58] Field of Search ..... 16/127, 126; 190/58 R

[56] References Cited

U.S. PATENT DOCUMENTS 2,332,765 10/1943 Thiele ..... 190/58 R

FOREIGN PATENT DOCUMENTS 1086309 8/1954 France ..... 190/58 R 1138688 1/1957 France ..... 190/58

*Primary Examiner*—Andrew V. Kundrat

*Attorney, Agent, or Firm*—Shapiro and Shapiro

[57] ABSTRACT

A device for mounting a handle on a luggage case or the like includes a stud having a pair of posts spaced apart on opposite ends of a mounting base. Between the posts is an opening through the stud sized to pass the end of a handle. The stud has a slot which extends perpendicular to the base on opposite sides of the opening into the interior of the posts. An L-shaped pin passed through a hole in the end of the handle is held closely captured in the slot to connect the handle to the stud.

7 Claims, 6 Drawing Figures

HANDLE MOUNTING DEVICE

BACKGROUND OF THE INVENTION

This invention relates to improvements in studs for mounting handles to luggage cases and similar kinds of articles.

A common handle stud is the post-type which generally comprises a pair of posts having a space between them mounted on a base adapted to be attached to the luggage case. The handle is attached to the stud by placing one end of the handle between the posts and inserting a pin through holes provided in the posts and the handle end. The pin is force fitted into the holes in the stud posts. The pin has a diameter smaller than the hole through the handle end. This allows the handle to rotate freely about the pin. A second stud is similarly supplied for the other end of the handle, so that the handle is thus mounted on the case free to swing about the pins through each end and connected thereto. The base of each stud is secured to the wall of the luggage case or the like by rivets or by pins cast integral with the base, the pins being swaged to make the connection.

Studs of the type just described have several disadvantages. These studs are normally die cast, thereby requiring core pull molds or secondary drilling operations to provide the holes for the pin. This complicates the manufacture of the studs. In addition, after the studs are manufactured, the handle and studs are usually assembled by first mounting the studs on a case. The handle ends are placed between the posts of the studs and the pins are driven through the holes in the posts and the handle ends. This is an awkward and costly operation, and the unsightly end of the pin in the post is always visible so that the handle mounting is not esthetically pleasing. Furthermore, it is possible for the pin to work its way loose and slip out of the holes in the posts, causing failure of the handle.

It is desired to achieve a mounting device which overcomes these disadvantages, and it is to this end that the invention is directed.

SUMMARY OF THE INVENTION

It is accordingly an object of the invention to provide a new and improved device for mounting handles on luggage cases and the like.

It is additionally an object to provide a mounting device which is easily and inexpensively manufactured.

It is also an object to provide a mounting device which is easily and quickly assembled.

It is a further object to provide a mounting device which is not subject to failure due to a pin working its way loose and slipping out of a hole in the device.

It is a still further object to provide a mounting device which is esthetically pleasing in appearance.

Briefly stated, a handle mounting device in accordance with the invention includes a stud having a base, an aperture extending through the stud and the base which is sized to pass the end of the handle, a slot which extends from the underside of the base on each side of the aperture to an interior position of the stud, and a pin sized to fit in the slot. The pin is adapted to be inserted through a hole in the end of the handle to support the handle in the stud.

More specifically, the pin is sized so that it is held closely captured in the slot. The handle and mounting device are assembled by first passing an end of the handle through the aperture provided in the stud, prior to mounting the stud on the case. The pin is inserted through a hole in the end of the handle, and the handle pulled back through the aperture to capture the pin in the slot. The base of the stud is then connected to the wall of a luggage case or the like, thereby retaining the pin in the slot and supporting the handle.

Preferably, the pin is L-shaped and dimensioned such that when it is inserted into the slot, the short arm of the pin bears against the case to which the stud is attached and the long arm cannot drop down because there is not enough clearance to allow the pin to rotate in the slot. As a result, the pin is held in a fixed position in the slot.

The aforementioned objects and certain other advantages, features and improved results provided by the invention will become apparent from the following description and drawing of a preferred embodiment.

DESCRIPTION OF THE PREFERRED EMBODIMENT

Figure 1:
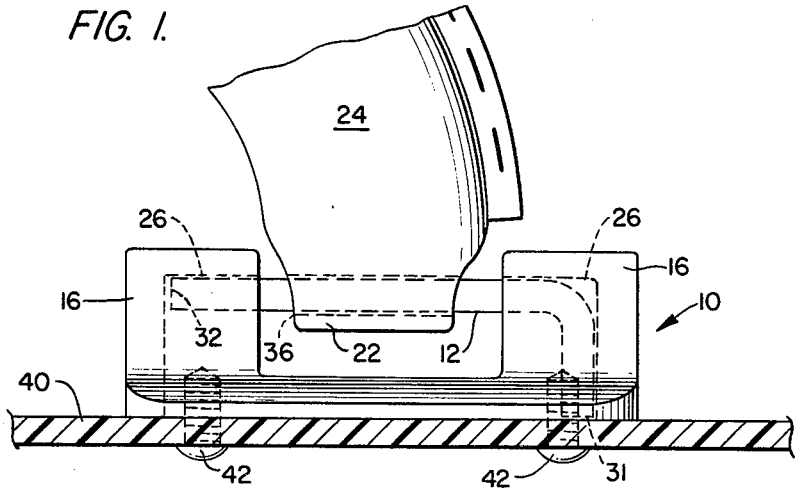
FIG. 1 is a side elevational view, partially in section, illustrating the mounting device of the invention, attached to a luggage case and supporting a handle partially shown.

The mounting device generally comprises a stud 10 and a pin 12. The stud has an internal slot 14 which is accessible through the underside of the stud. The slot is closed at each end thereof and is dimensioned to accept the pin with a close fit. When the stud is mounted on a luggage case, the pin is retained in the slot and supports a handle end in the stud. The stud preferably has a pair of upstanding projections or posts 16 extending upwardly from opposite ends of base 18. The base may be circular, ellptical or generally rectangular, the latter configuration being illustrated. Between the posts there is an aperture or opening 20 which extends entirely through the stud, including the base. The opening, which may be of any convenient shape, is sized to pass the end 22 of a handle 24.

Figure 2:
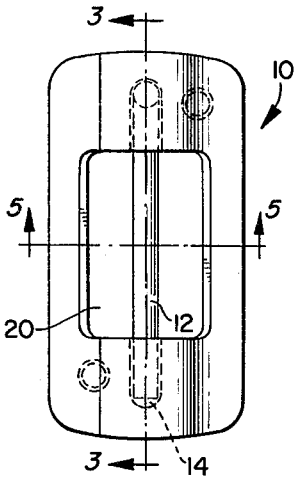
FIG. 2 is a top plan view of the mounting device.
Figure 4:
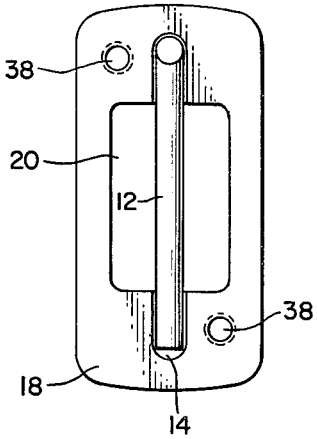
FIG. 4 is a bottom view of the device of FIG. 2.
Figure 5:
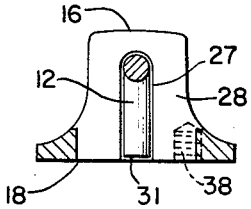
FIG. 5 is a sectional view taken approximately in the plane of line 5—5 of FIG. 2.
Figure 6:
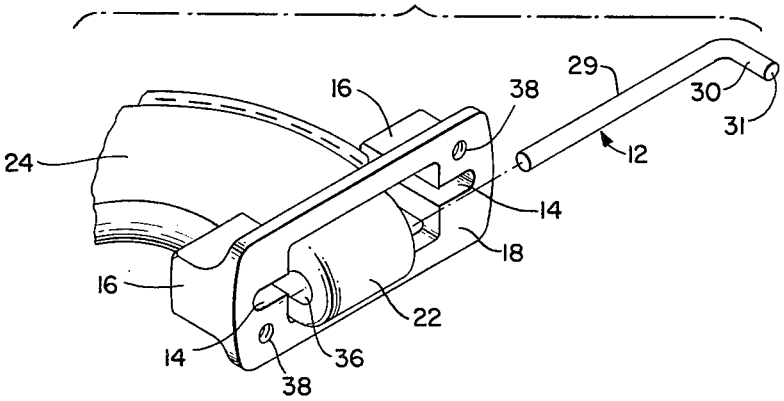
FIG. 6 is a perspective view illustrating the assembly of the handle and mounting device.

As illustrated in FIGS. 2, 4, and 6, slot 14 is centrally positioned longitudinally in the base and in the posts 16 so that it substantially bisects opening 20. The slot has a length greater than the spacing between the posts but less than the length of the stud. The slot further extends perpendicular to the plane of the base into the interior of the stud to an intermediate position 26 which forms the upper side of the slot within each of the posts 16, and forms vertical slots 27 (FIG. 5) in the opposing faces 28 of the posts adjacent to opening 20. Slot 14 is accessible only from the underside of the stud. The pin 12 has a length and width slightly less than the length and width of slot 14, and can be inserted into the slot only through the underside of the stud. Since the pin is confined by the sides of the slot, it is held in bisecting relationship with opening 20, and is supported in the slot at a predetermined position with respect to the base.

Figure 3:
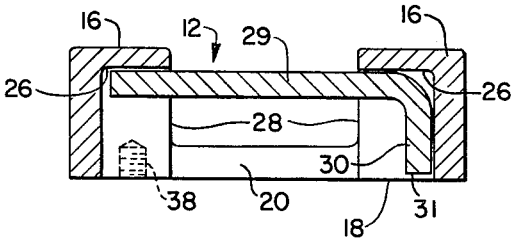
FIG. 3 is a sectional view taken approximately in the plane of line 3—3 of FIG. 2.

Preferably, the pin is an L-shaped rod, as illustrated in FIGS. 1, 3 and 6. The long leg 29 of the pin has a length slightly less than the length of slot 14. The short leg 30 of the pin has a length substantially equal to the height of the slot in the stud, so that when the stud is mounted on a luggage case with the pin in place, end 31 of the short leg of the pin contacts the luggage case to force the long leg of the pin against the upper side 26 of the slot, as illustrated in FIG. 1. The diameter of the pin is made slightly less than the width of the slot, and since the length of the long leg 29 is slightly less than the length of the slot 14, the pin is held closely captured in the slot; the pin cannot rotate in the slot. Therefore, when the stud is mounted on a luggage case, the pin through the end of a handle supports the handle in the stud. If a downward pressure is applied to the handle, as viewed in FIG. 1, the left end 32 of the long leg of the pin cannot drop downward since the pin cannot rotate in the slot. The handle is thus supported in a vertical direction. When the case to which the handle is mounted is lifted, the pin engaging the upper sides 26 of the slot transmits the lifting force to the case.

Since the pin is completely captured in the slot, it cannot slip out of the slot to cause the handle to fail. Furthermore, since there are no horizontal or visible holes through the posts of the stud, the ends of the pin are not visible, and the pin cannot work loose and slip out. Accordingly, all of the characteristics of a post-type handle stud are obtained without manufacturing, assembly and esthetic disadvantages possessed by prior studs.

The mounting device of the invention may be quickly and easily assembled. As illustrated in FIG. 6, the end of a handle is passed through the opening 20 of the stud a sufficient distance to permit the pin to be inserted into a hole 36 provided in the handle end. The handle is then pulled back through the opening 20 to capture the pin in the slot. The stud can then be mounted on a luggage case in a conventional manner. Holes 38 may be provided in the base 18 and the stud attached to the wall 40 of the luggage case with threaded fasteners 42, as illustrated in FIG. 1. The fasteners may be received in holes 38.

The stud may be conveniently formed by die casting zinc alloys as well-known in the art, and then plating with chromium or brass. The stud may take on a variety of shapes and sizes to conform with the appearance of the case to which it is attached. If desired, the stud may be cast with spaced connecting pins on the underside of the base, which after being passed through openings in a luggage wall have their ends swaged over. Pin 12 may be conveniently formed from a steel rod sized and bent into an L-shape of the desired dimensions with respect to the slot in which it will be situated.

It is an advantage that pin 12 is L-shaped. This facilitates the assembly of the handle to the stud and permits it to be used with a variety of handles, including those with limited hole clearance, e.g., plastic handles. It is contemplated however, that a straight pin or an inverted U-shaped pin may be used, through pins of such configurations are not as desirable for the realization of all of the advantages of the preferred form of the invention.

While the forgoing description has been with reference to a particular illustrated embodiment of the invention, it will be apparent that various changes and modifications may be made without departing from the principles and spirit of the invention, the scope of which is defined in the appended claims.

I claim:

1. A device for mounting a handle on a luggage case or the like comprising a stud having a base, an aperture extending through the base and sized to pass an end of a handle, a slot in the base having a width substantially less than the width of the aperture and having first and second slot portions intersecting opposite ends of said aperture and extending beyond said ends and upwardly with said aperture from the underside of the base to a terminus within the interior of the stud, and a pin sized to fit in the slot, the pin being adapted to be inserted through a hole in the end of the handle to support the handle in the stud.

2. A device according to claim 1 wherein the pin is L-shaped, having a long leg and a short leg, and wherein the length of the long leg is slightly less than the length of the slot and the length of the short leg is substantially equal to the height of the slot.

3. A device according to claim 1 wherein the pin has a length and width slightly less than the length and width of the slot.

4. A device according to claim 3 wherein the stud includes a pair of upstanding projections on opposite ends of the base, the slot being formed in the projections, and wherein the aperture is positioned in the base between the projections.

5. A device according to claim 4 wherein the slot substantially bisects the aperture.

6. A device according to claim 1 or 2 wherein the base of the stud includes means for mounting the stud on a luggage case.

7. A device according to claim 6 wherein the mounting means include spaced holes, each adapted to receive a threaded fastener.

* * * * *